US006382809B1

(12) United States Patent
Ou-Yang

(10) Patent No.: US 6,382,809 B1
(45) Date of Patent: May 7, 2002

(54) LIGHT EMITTER AT UMBRELLA HEAD PORTION

(76) Inventor: Wei Ou-Yang, No.24, Alley 47, Lane 115, Sec.2, Cheng Kung Rd., Taipei (TW)

( * ) Notice: Subject to any disclaimer, the term of this patent is extended or adjusted under 35 U.S.C. 154(b) by 0 days.

(21) Appl. No.: 09/542,835

(22) Filed: Apr. 4, 2000

(51) Int. Cl.[7] ..... A45B 3/02

(52) U.S. Cl. ..... 362/102; 362/394; 362/276; 135/910; 200/511; 200/314

(58) Field of Search ..... 362/102, 95, 103, 362/84, 189, 276, 802, 394; 446/438, 439; 273/DIG. 8; 473/570; 200/314, 317, 310, 511, 512, 513; 135/910

(56) References Cited

U.S. PATENT DOCUMENTS 4,875,200 A * 10/1989 Tillery ..... 362/23
5,515,248 A * 5/1996 Canfield et al. ..... 362/116
5,611,621 A * 3/1997 Chien ..... 362/84
5,655,826 A * 8/1997 Kouno et al. ..... 362/24
5,901,834 A * 5/1999 Inubushi et al. ..... 200/314
6,042,004 A * 3/2000 Domiteaux ..... 235/280
6,158,451 A * 12/2000 Wu ..... 362/102

* cited by examiner

*Primary Examiner*—Thomas M. Sember
(74) *Attorney, Agent, or Firm*—Rosenberg, Klein & Lee

(57) ABSTRACT

A light emitter at an umbrella head portion comprises a combining seat, an elastic switch, an light emitting element, a circuit board, a battery, and an elastic lampshade. The lower end of the combining seat is connected to the top of the main rib. The upper end of the combining seat is installed with a receiving chamber which receives the battery and the circuit board for providing power and a control circuit. A light emitting element is mounted above the circuit board, and at the outer ring of the elastic lampshade and the protruding ring at the outer periphery of the combining seat. As the elastic lampshade is pressed, the lampshade moves downwards so that the elastic switch of the lampshade transfers a current signal to the circuit board for actuating the control circuit to light up the light emitting element. If the elastic lampshade is further pressed, the light emitting element will be turned off.

8 Claims, 9 Drawing Sheets

LIGHT EMITTER AT UMBRELLA HEAD PORTION

FIELD OF THE INVENTION

The present invention relates to a light emitter at an umbrella head portion, and especially to a light emitter installed at the upper end of an umbrella which may emit light.

BACKGROUND OF THE INVENTION

In the daily life, despite a rainy day or a shining day, many peoples may carry an umbrella for shielding rains or sunlight. Therefore, umbrellas are important tools for peoples. From the ancient time, the structures of umbrellas have been change many times, for example, the canopy of an umbrella is changed from oil paper to a water-proof cloth and further to violet-resistant cloth. Another, a two folds, three folds, etc umbrellas are designed for being stored easily. Therefore, an umbrella with a light emitter is never commercially sold. However, such kind of umbrella provides illumination to an umbrella, thereby, the user may illuminate the outer environment by that umbrella without needing to further carry another lamp, or it may used to alert the driver of a coming car so as to increase the safety in traffic.

SUMMARY OF THE INVENTION

Accordingly, the primary object of the present invention is to provide a light emitter at an umbrella head portion, the umbrella has the function of illumination, especially, in a dark circumference, raining, or bad visual sight. It will alert a driver to take care of those carrying this umbrella at a farther distance. Therefore, the traffic safety is increased. The light also has the function of illumination to illuminate the front path. Moreover, this kind of umbrella can be used as a decoration for viewing.

In order to achieve the aforesaid object, the present invention provides a light emitter at the umbrella head portion comprises a combining seat, an elastic switch, an light emitting element, a circuit board, a battery, and an elastic lampshade. The lower end of the combining seat is connected to the top of the main rib. The upper end of the combining seat is installed with a receiving chamber which receives with the battery and the circuit board for providing power and a control circuit. A light emitting element is mounted above the circuit board, or at the outer ring of the elastic lampshade or the protruding ring at the outer periphery of the combining seat. As the elastic lampshade is pressed, the lampshade moves downwards so that the elastic switch of the lampshade transfers a current signal to the circuit board for actuating the control circuit to light up the light emitting element. If the elastic lampshade is further pressed, the light emitting element will be turned off.

The various objects and advantages of the present invention will be more readily understood from the following detailed description when read in conjunction with the appended drawing.

DETAILED DESCRIPTION OF THE PREFERRED EMBODIMENTS

Figure 1:
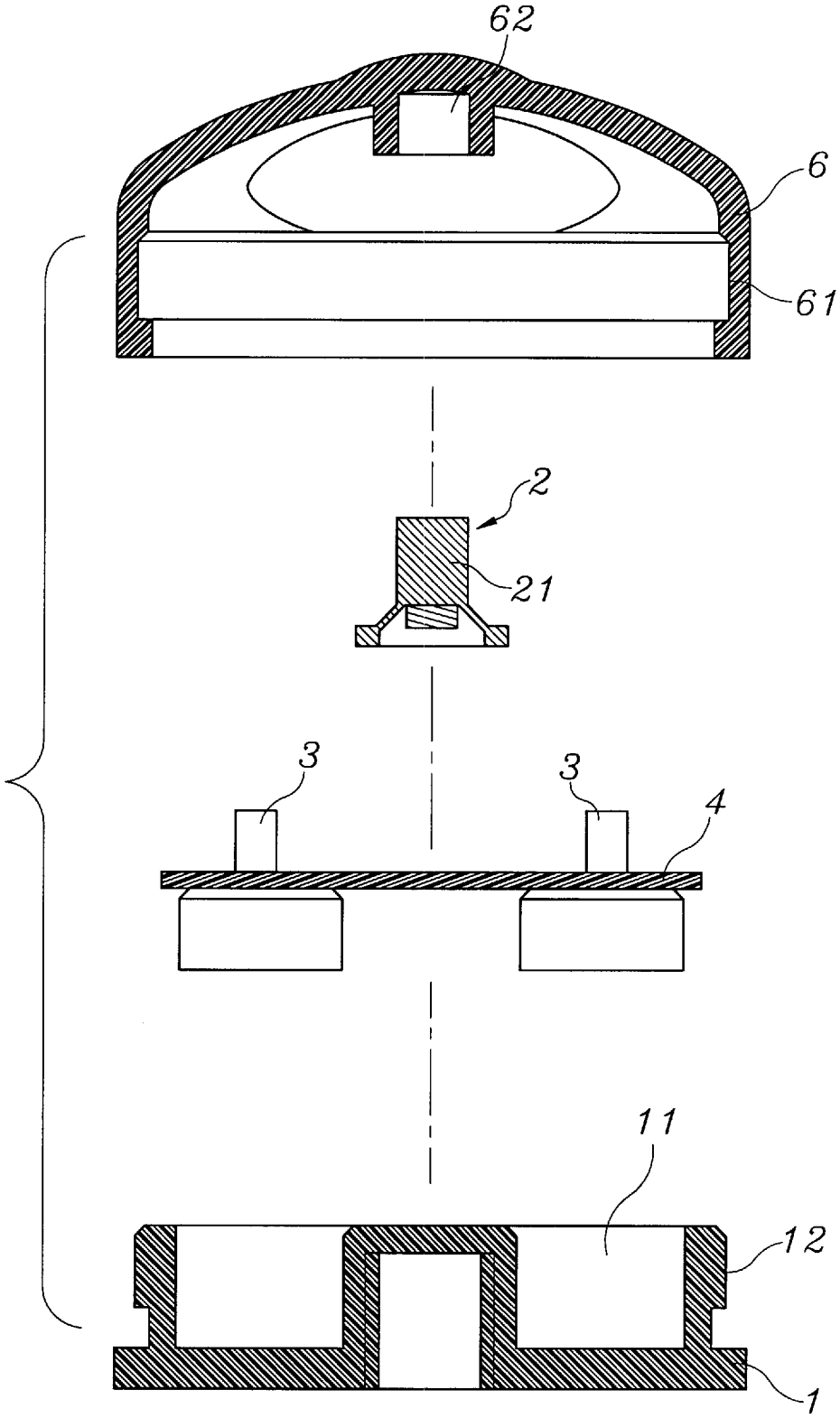
FIG. 1 is an exploded perspective view of the first embodiment in the present invention.
Figure 2:
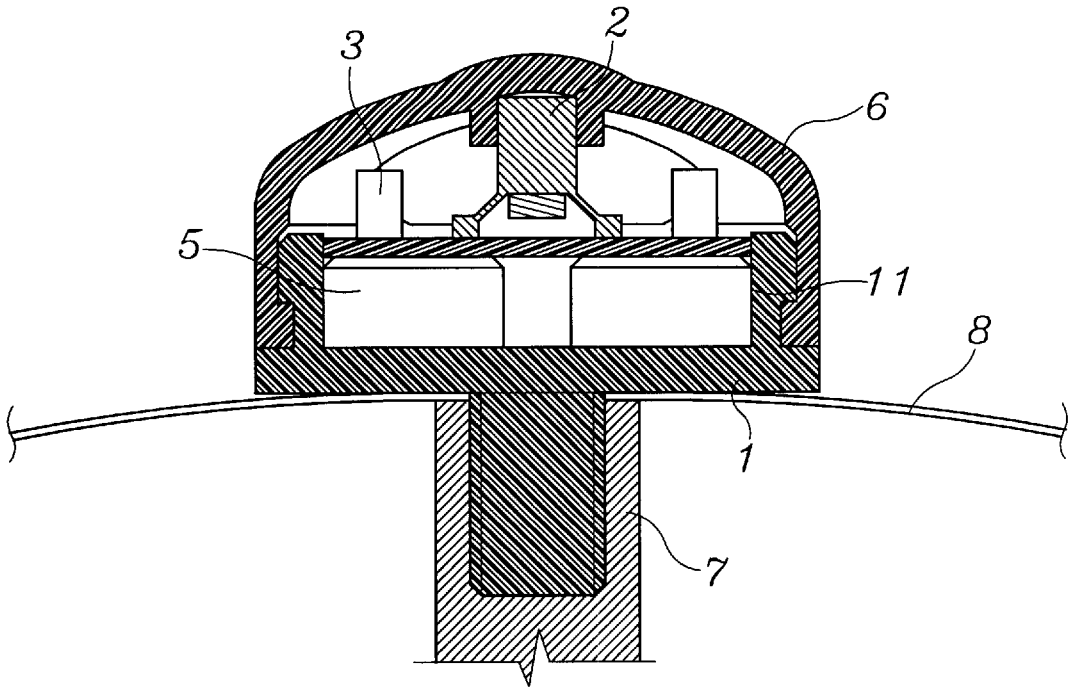
FIG. 2 is an assembled cross sectional view of the first embodiment in the present invention.
Figure 3:
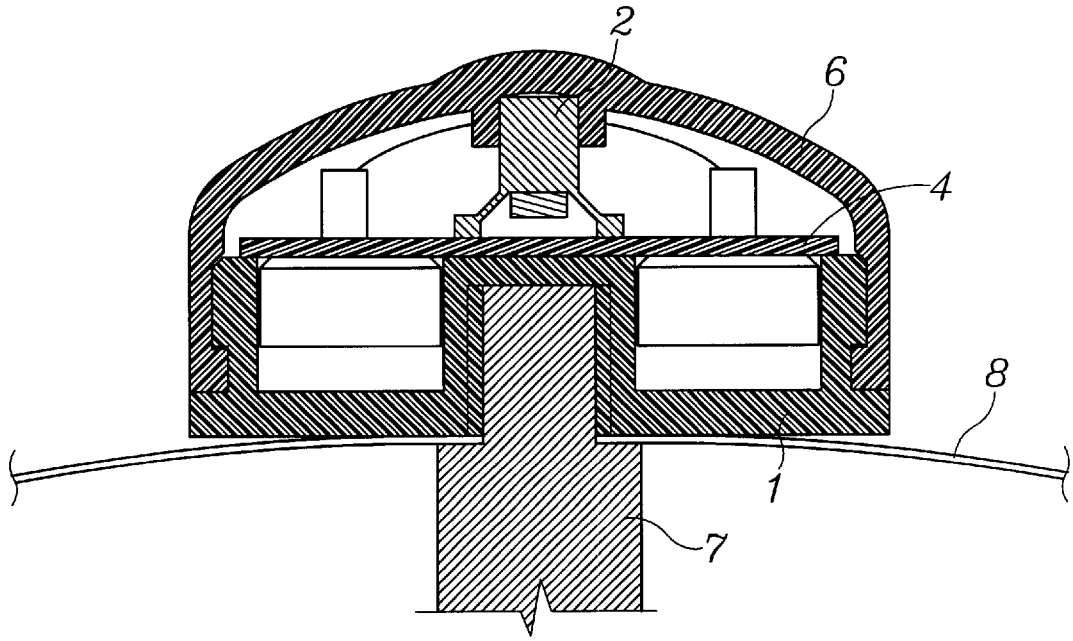
FIG. 3 is an assembled cross sectional view of the second in the present invention.
Figure 4:
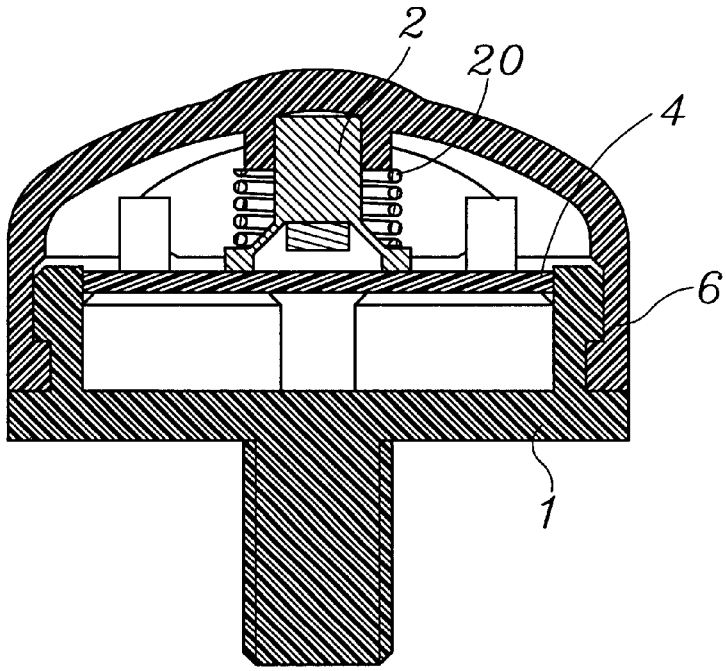
FIG. 4 is an assembled cross sectional view of the third embodiment in the present invention.
Figure 5:
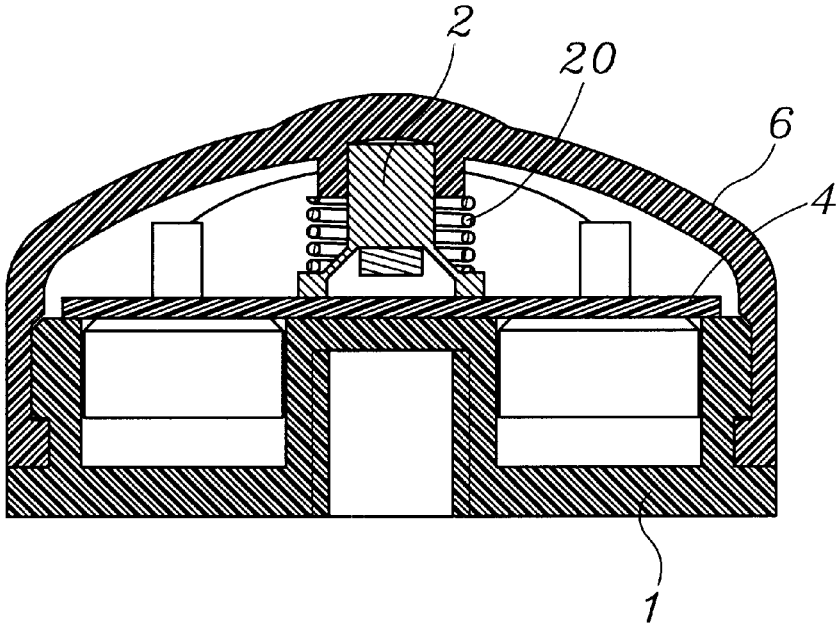
FIG. 5 is an assembled cross sectional view of the fourth embodiment in the present invention.
Figure 6:
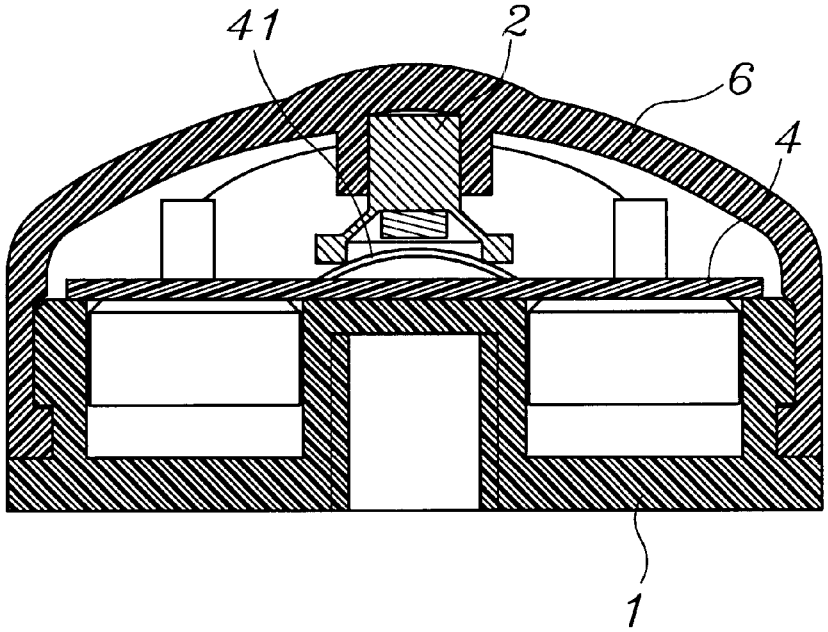
FIG. 6 is an assembled cross sectional view of the fifth embodiment in the present invention.
Figure 7:
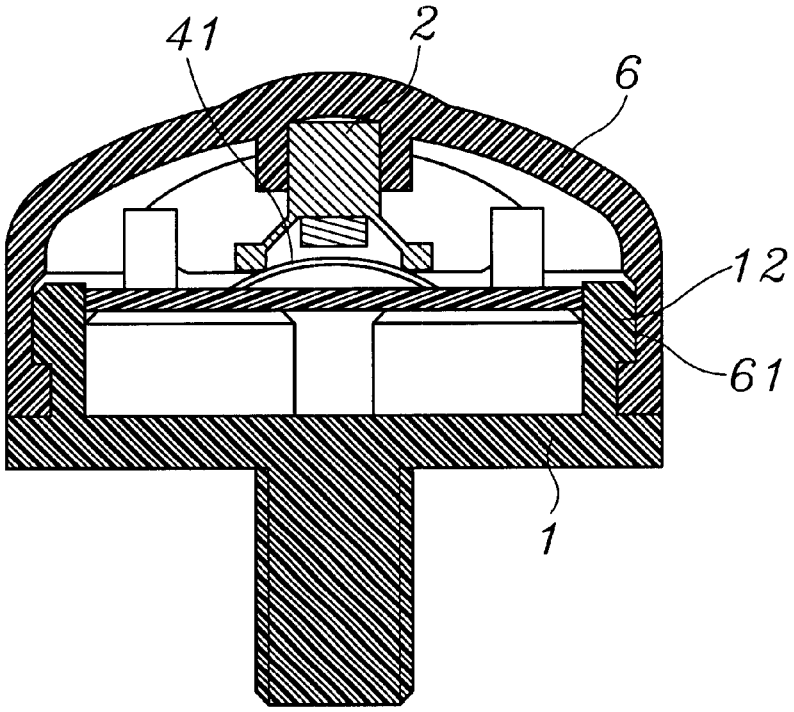
FIG. 7 is an assembled cross sectional view of the sixth embodiment in the present invention.
Figure 8:
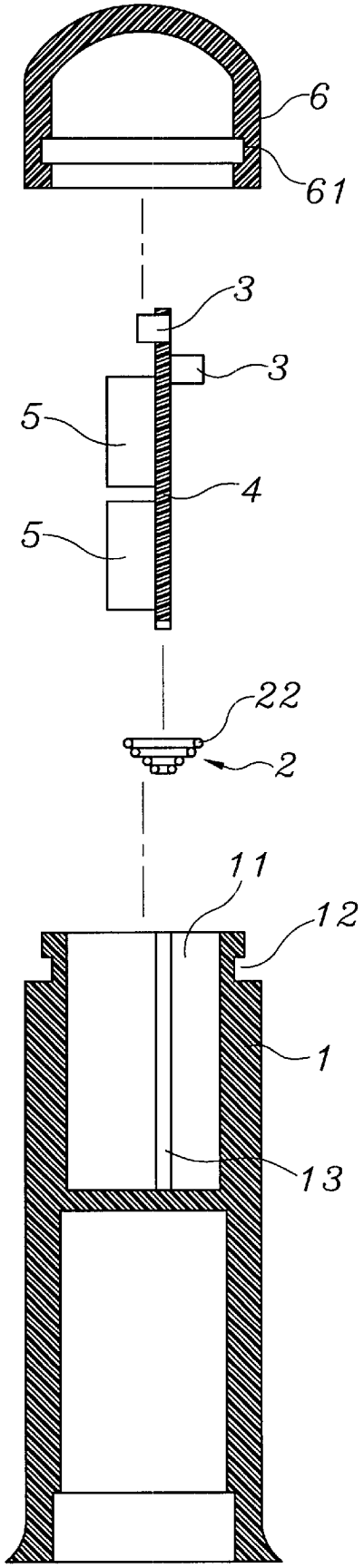
FIG. 8 is an assembled cross sectional view of the seventh embodiment in the present invention.
Figure 9:
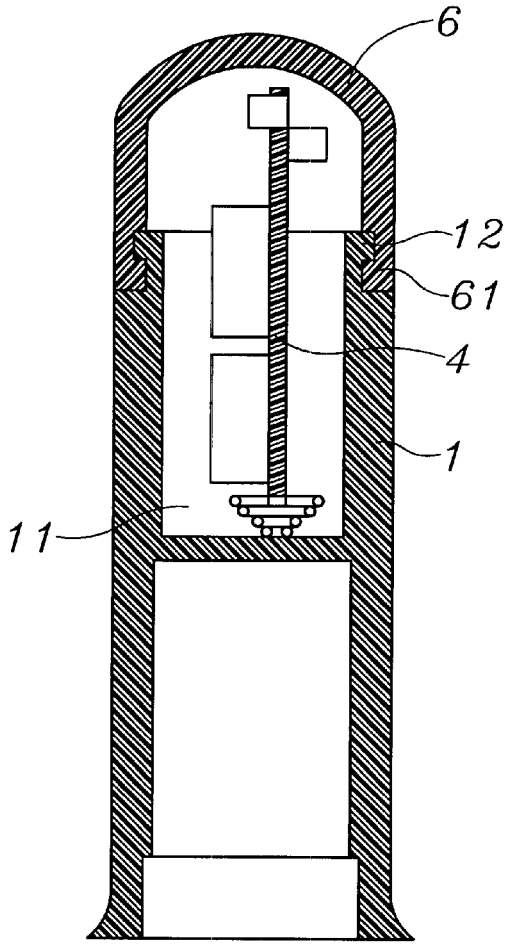
FIG. 9 is an assembled cross sectional view of the seven embodiment in the present invention.
Figure 10:
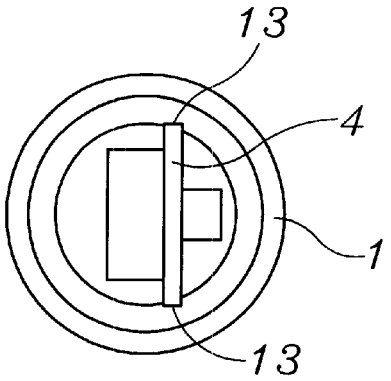
FIG. 10 is an upper view showing the assembling of the seat and the circuit board in the seventh embodiment of the present invention.
Figure 11:
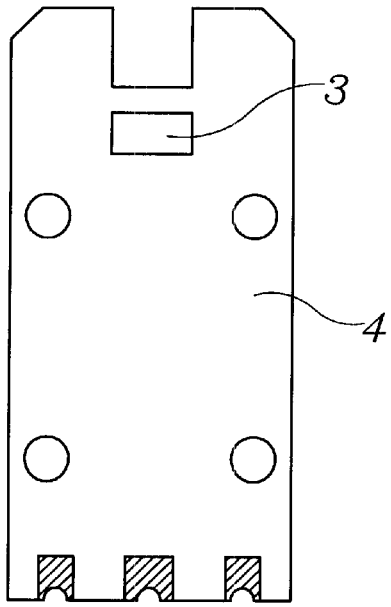
FIG. 11 is a right side view of the circuit board in FIG. 8 of the present invention.
Figure 12:
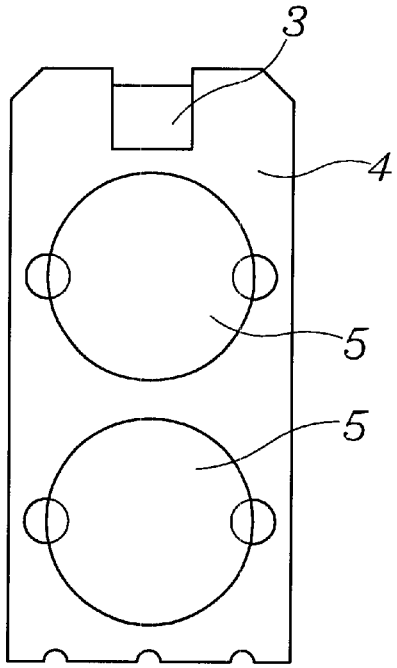
FIG. 12 is the left side view of the circuit board in FIG. 8 of the present invention.
Figure 13:
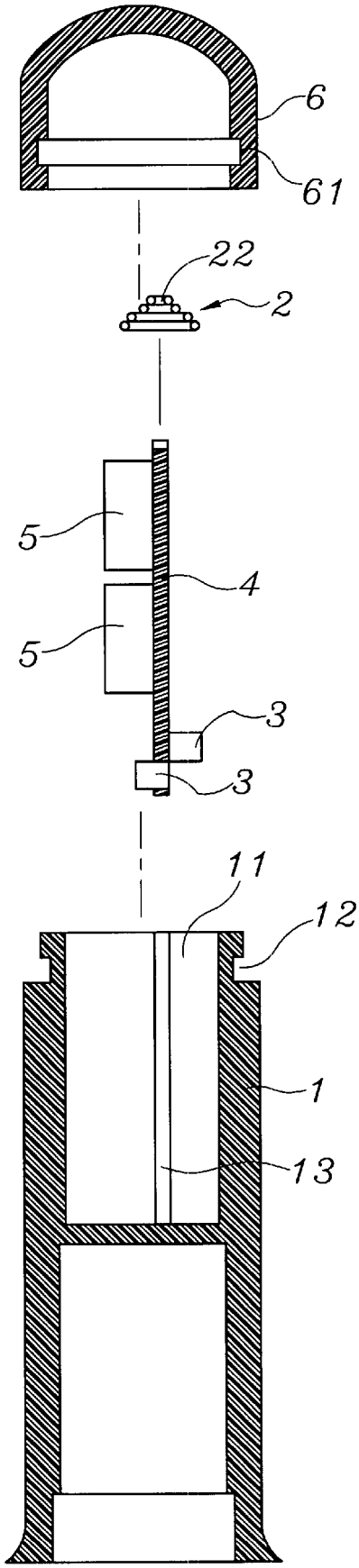
FIG. 13 is an exploded cross sectional view of the eighth embodiment of the present invention.
Figure 14:
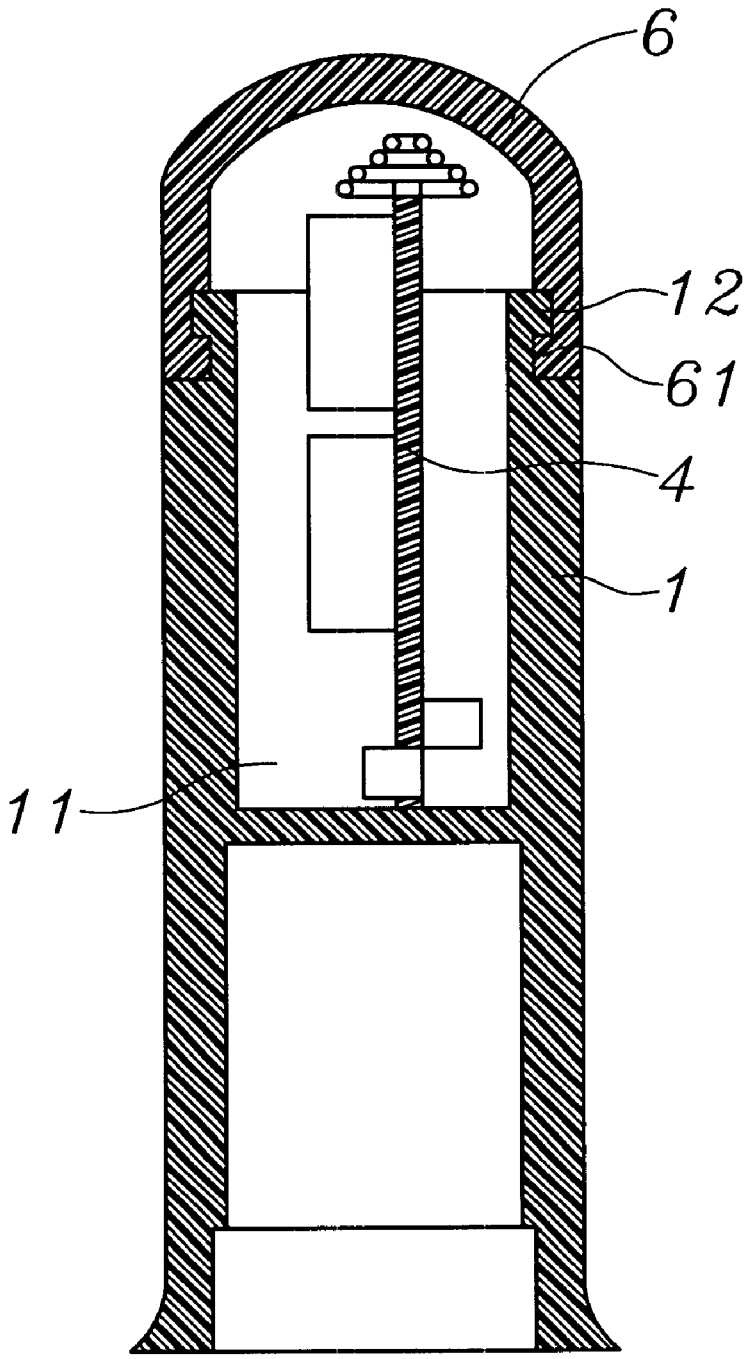
FIG. 14 is an assembled cross sectional view of the eighth embodiment of the present invention.

With reference to FIGS. 1 to 14, eight embodiments of the light emitter at an umbrella head portion in the present invention are illustrated. In the present invention, a light emitter is mounted at the top end of the main rib 7 external to the umbrella cloth 8. This light emitter has a combining seat 1, an elastic switch 2, a light emitting element 3, a circuit board 4, a battery 5 and an elastic lampshade 6. The lower end of the combining seat 1 is connected to the top of the main rib 7. The upper end of the combining seat 1 is installed with a receiving chamber 11 which receives with the battery 5 and the circuit board 4 for providing power and a control circuit. A light emitting element 3 is mounted above the circuit board 4. At the outer ring 61 of the elastic lampshade 6 and the protruding ring 12 at the outer periphery of the combining seat 1, as the elastic lampshade 6 is pressed, the lampshade 6 moves downwards so that the elastic switch 2 of the lampshade 6 transfers a current signal to the circuit board 4 for actuating the control circuit to light up the light emitting element 3. If the elastic lampshade 6 is further pressed, the light emitting element 3 will be turned off. That is to say, it is only needed to contact the elastic lampshade of the head portion to any hard surface, then the switch 2 can be turned on or off so as to be formed with an easily used structure.

According to the applications, eight embodiments of the present invention can be illustrated. In the first and sixth embodiments, the circuit board, is located horizontally, i.e. transversally. In the seventh and eighth embodiments, the circuit board 4 is sandwiched between a pair of clamping groove 13. In the seventh embodiment, the lower end of the circuit board 4 is connected with an elastic switch 2 (in this embodiment, it is a helical spring 22), so that another end of the helical spring 22 (upper end of the figure) contacts with a joint of a the circuit board 4, and thus a signal is generated. Further, in eighth embodiment, the circuit board 4 and the elastic switch 2 are at positions inversely those illustrated in the seventh embodiment. In first and sixth embodiments, the elastic switch 2 is a conductive rubber 21. The upper end of the conductive rubber 21 is fixed to the fixing groove 21 of the lampshade 6 so as to move with the lampshade 6. Thus, the conductive end at the bottom of the conductive rubber 21 will contact with the circuit board 4 and then is conductive. The lampshade is transparent or semi-transparent. The battery set may be at least one mercury battery, etc. The difference of the second, fourth, sixth embodiments from the first, third, and fifth embodiments is the combining way of the seat and the rib. In the latter, the bottom of the seat 1 is a concave threaded hole for being connected to the thread of the main rib 7. While the former has a design inverse to this embodiment, the bottom of the seat 1 has a protruded thread for being locked to the threaded hole of the main rib 7. That is, a male seat and a female seat are formed, respectively for, being suitable to ribs of different form. The consumer may select and update the desired design. In the first, second, third and fourth embodiments, a circle spring 20 is installed aside the conductive rubber 21 for enhancing the elastic thereof so that as the umbrella is folded for being stored, it will not light up, due to a slight contact. In the fifth and sixth embodiments, a protruded elastic contact elastic piece 41 is installed on the circuit board 4 for reducing the moving distance in contact.

In summary, in the aforesaid structure of the present invention, a light emitter installed, on the rib is installed and a switch is directly installed within the light emitter. As the elastic switch is triggered and lighted up, the light emitter will light up, and therefore, the umbrella has the function of illumination, especially, in a dark circumference, raining, or bad visual sight. It will alert a driver to take care of those carrying this umbrella at a farther distance. Therefore, the traffic safety is increased. The light also has the function of illumination to illuminate the path. Moreover, this kind of umbrella can be used as a decoration for viewing.

Although the present invention has been described with reference to the preferred embodiments, it will be understood that the invention is not limited to the details described thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A combined light emitter and umbrella comprising:

an umbrella having an axially extended umbrella shaft supporting an umbrella cloth;

a combining seat having a bottom end coupled to an upper end of said umbrella shaft adjacent and external to said umbrella cloth, said combining seat having an upper end formed with a receiving chamber therein and an outer periphery having a protruding ring portion;

a battery disposed in said receiving chamber;

a circuit board disposed in said receiving chamber and electrically connected to said battery;

a light emitting element mounted on said circuit board;

an elastic switch mounted to said circuit board and having a portion spaced from said circuit board for energizing said light emitting element responsive to a displacement of said spaced portion of said elastic switch into contact with said circuit board; and, an elastic lampshade overlaying said upper end of said combining seat and having an outer ring portion engaged with the protruding ring portion of said combining seat, said elastic lampshade forming a closure for said receiving chamber, a portion of said elastic lampshade being depressable to displace said spaced portion of said elastic switch and thereby selectively energize and de-energize said light emitting element.

2. The combined light emitter and umbrella as recited in claim 1, wherein said circuit board extends within said receiving chamber in a direction transverse said axial direction.

3. The combined light emitter and umbrella as recited in claim 1, wherein said circuit board extends axially within said receiving chamber.

4. The combined light emitter and umbrella as recited in claim 3, wherein said elastic switch is mounted to an end of said circuit board.

5. The combined light emitter and umbrella as recited in claim 1, wherein said spaced portion of said elastic switch is formed of conductive rubber.

6. The combined light emitter and umbrella as recited in claim 1, wherein said spaced portion of said elastic switch is formed by a portion of a helical spring.

7. The combined light emitter and umbrella as recited in claim 1, wherein said elastic lampshade has a fixing groove formed therein for receiving said spaced portion of said elastic switch therein.

8. A combined light emitter and umbrella comprising:

an umbrella having an umbrella shaft supporting an umbrella cloth;

a combining seat having a bottom end coupled to an upper end of said umbrella shaft adjacent and external to said umbrella cloth, said combining seat having an upper end formed with a longitudinally extended receiving chamber therein and an outer periphery having a protruding ring portion;

a circuit board extending longitudinally within said receiving chamber and electrically connected to said battery;

a battery mounted on said circuit board and electrically connected thereto;

a light emitting element mounted on said circuit board;

an elastic switch mounted to a longitudinal end of said circuit board adjacent a bottom end of said receiving chamber, said elastic switch having a portion thereof spaced from said circuit board for energizing said light emitting element responsive to a displacement of said circuit board into contact with said spaced portion of said elastic switch; and, an elastic lampshade overlaying said upper end of said combining seat and having an outer ring portion engaged with the protruding ring portion of said combining seat, said elastic lampshade forming a closure for said receiving chamber, a portion of said elastic lampshade being depressable to longitudinally displace said circuit board and thereby selectively energize and de-energize said light emitting element.

* * * * *